US009978324B2

(12) United States Patent
Hsieh et al.

(10) Patent No.: US 9,978,324 B2
(45) Date of Patent: May 22, 2018

(54) DRIVER APPLIED TO DISPLAY APPARATUS

(71) Applicant: Raydium Semiconductor Corporation, Hsinchu (TW)

(72) Inventors: Kun-Chan Hsieh, Hsinchu (TW); Chih Chuan Huang, Kaohsiung (TW); Feng-Li Lin, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 205 days.

(21) Appl. No.: 15/170,736

(22) Filed: Jun. 1, 2016

(65) Prior Publication Data

US 2017/0053609 A1 Feb. 23, 2017

(30) Foreign Application Priority Data

Aug. 21, 2015 (TW) ..... 104127407 A

(51) Int. Cl.
*G09G 3/36* (2006.01)

(52) U.S. Cl.
CPC ..... *G09G 3/3614* (2013.01); *G09G 3/3688* (2013.01); *G09G 3/3648* (2013.01)

(58) Field of Classification Search
CPC ..... G09G 3/3614; G09G 2310/0297; G09G 2310/0286; G09G 3/3607; G09G 3/3611; G09G 3/3674; G09G 2300/0814
See application file for complete search history.

(56) References Cited

U.S. PATENT DOCUMENTS

2007/0296661 A1* 12/2007 Ishiguchi ..... G09G 3/3688 345/87
2013/0147724 A1* 6/2013 Hwang ..... G06F 3/0412 345/173
2013/0181963 A1* 7/2013 Chuang ..... G09G 3/3607 345/208
2016/0275894 A1* 9/2016 Dai ..... G02F 1/136286
2016/0351124 A1* 12/2016 Kim ..... G09G 3/3241

* cited by examiner

*Primary Examiner* — Gerald Johnson

(57) ABSTRACT

A driver applied to a display apparatus is disclosed. The driver includes 2(N+1) source channels, M display lines, and an output polarity control module. N and M are positive integers. Polarity outputs of the M display lines are independently controlled and have no dependencies between each other. The output polarity control module provides (N+1) polarity inversion control signals. A K-th polarity inversion control signal of the (N+1) polarity inversion control signals controls polarities outputted by the (2K−1)-th source channel and the 2K-th source channel of the 2(N+1) source channels. K is a positive integer and 1≤K≤(N+1).

10 Claims, 5 Drawing Sheets

| | CH1 | CH2 | CH3 | CH4 | CH5 | CH6 | CH7 | CH8 | | CH(2N-1) | CH(2N) | CH[2(N+1)-1] | CH[2(N+1)] |
|---|---|---|---|---|---|---|---|---|---|---|---|---|---|
| L1 | − | + | − | + | + | − | + | − | ..... | − | + | − | + |
| L2 | + | − | + | − | − | + | − | + | ..... | + | − | + | − |
| L3 | + | − | + | − | − | + | − | + | ..... | + | − | + | − |
| L4 | − | + | − | + | + | − | + | − | ..... | − | + | − | + |
| ⋮ | − | + | − | + | + | − | + | − | ..... | − | + | − | + |
| ⋮ | + | − | + | − | − | + | − | + | ..... | + | − | + | − |
| ⋮ | + | − | + | − | − | + | − | + | ..... | + | − | + | − |
| LM | − | + | − | + | + | − | + | − | ..... | − | + | − | + |

| | CH1 | CH2 | CH3 | CH4 | CH5 | CH6 | CH7 | CH8 | | CH(2N-1) | CH(2N) | CH[2(N+1)-1] | CH[2(N+1)] |
|---|---|---|---|---|---|---|---|---|---|---|---|---|---|
| L1 | − | + | − | + | + | − | + | − | ..... | − | + | − | + |
| L2 | + | − | + | − | − | + | − | + | ..... | + | − | + | − |
| L3 | + | − | + | − | − | + | − | + | ..... | + | − | + | − |
| L4 | − | + | − | + | + | − | + | − | ..... | − | + | − | + |
| ⋮ | − | + | − | + | + | − | + | − | ..... | − | + | − | + |
| ⋮ | + | − | + | − | − | + | − | + | ..... | + | − | + | − |
| ⋮ | + | − | + | − | − | + | − | + | ..... | + | − | + | − |
| LM | − | + | − | + | + | − | + | − | ..... | − | + | − | + |

FIG. 3A

| − | + | − | + | + | − | + | − | ..... | − | + | − | + |
|---|---|---|---|---|---|---|---|---|---|---|---|---|
| CH1 | CH2 | CH3 | CH4 | CH5 | CH6 | CH7 | CH8 | | CH(2N-1) | CH(2N) | CH[2(N+1)-1] | CH[2(N+1)] |
| POL(1)=0 | | POL(2)=0 | | POL(3)=1 | | POL(4)=1 | | | POL(N)=0 | | POL(N+1)=0 | |

FIG. 3B

DRIVER APPLIED TO DISPLAY APPARATUS

BACKGROUND OF THE INVENTION

Field of the Invention

This invention relates to a display apparatus, especially to a driver having a polarity inversion control function applied to a display apparatus.

Description of the Related Art

In general, in the application of the LCD display panel, when a voltage on the electrode is provided to the liquid crystals through the orientation layer, the DC blocking effect failing to change the arrangement of the liquid crystals and the DC residue effect of the moveable ions around the liquid crystals driven by the voltage may be generated.

Therefore, lots of pixel matrix polarity inversion methods, such as frame inversion, column inversion or dot inversion, are used to drive the liquid crystals to solve the above-mentioned problems. Because these three polarity inversion methods have their own drawbacks respectively, a polarity inversion method of (2V+1) dual line dot inversion is developed based on the column inversion and the dot inversion.

When the display panel is verified, some "killer patterns" are usually used to verify the quality of the pixels of the display panel. For example, as shown in FIG. 1, the frame of 3V3H pixel matrix under dot inversion is light and dark staggered. For the display lines L1~L6, the polarity output sequence of the display lines L1, L3 and L5 is (+,−,+,−,+,−); the polarity output sequence of the display lines L2, L4 and L6 is (−,+,−,+,−,+). The output channels CH60 and CH63 correspond to the red color (R); the output channels CH61 and CH64 correspond to the green color (G); the output channels CH62 and CH65 correspond to the blue color (B). At this time, the output data signals and polarities of the output channels CH60~CH65 are shown in FIG. 2A~FIG. 2C respectively.

It should be noted that under the ideal condition, the common voltage VCOM of the display panel will be fixed to a certain level, as shown by the dotted lines of FIG. 2A~FIG. 2C. However, in practical applications, because the output voltage will pull the common voltage VCOM of the display panel through the thin-film transistor TFT, the common voltage (VCOM) jitters occur on the conventional display panel, as shown by the bold lines of FIG. 2A~FIG. 2C. At this time, the frame displayed by the display panel will be abnormal due to the common voltage (VCOM) jitters of the display panel, such as color deviations of the frame.

SUMMARY OF THE INVENTION

Therefore, the invention provides a driver applied to a display apparatus to solve the above-mentioned problems.

An embodiment of the invention is a driver applied to a display apparatus. In this embodiment, the driver includes 2(N+1) source channels, M display lines and an output polarity control module. The 2(N+1) source channels include a first source channel, a second source channel, . . . , a (2N+1)-th source channel and a 2(N+1)-th source channel, wherein N is a positive integer. The M display lines include a first display line, a second display line, . . . , a (M−1)-th display line and a M-th display line, wherein polarity outputs of the M display lines are independently controlled and the polarity outputs of the M display lines have no dependencies between each other, wherein M is a positive integer. The output polarity control module is configured to provide (N+1) polarity inversion control signals including a first polarity inversion control signal, a second polarity inversion control signal, . . . , a N-th polarity inversion control signal and a (N+1)-th polarity inversion control signal, wherein a K-th polarity inversion control signal of the (N+1) polarity inversion control signals controls polarities outputted by a (2K−1)-th source channel and a 2K-th source channel of the 2(N+1) source channels, and K is a positive integer and $1 \leq K \leq (N+1)$.

In an embodiment, the first source channel, the second source channel, . . . , the (2N+1)-th source channel and the 2(N+1)-th source channel are arranged in order along a first direction; the first display line, a second display line, . . . , a (M−1)-th display line and a M-th display line are arranged in order along a second direction.

In an embodiment, the first direction is perpendicular to the second direction.

In an embodiment, a value of M depends on a solution of a display panel of the display apparatus along the second direction.

In an embodiment, when the K-th polarity inversion control signal has a first level, the K-th polarity inversion control signal controls the polarities outputted by the (2K−1)-th source channel and the 2K-th source channel to be negative (−) and positive (+) respectively; the K-th polarity inversion control signal has a first level, when the K-th polarity inversion control signal has a second level, the K-th polarity inversion control signal controls the polarities outputted by the (2K−1)-th source channel and the 2K-th source channel to be positive (+) and negative (−) respectively.

In an embodiment, the first level is higher than the second level.

In an embodiment, the (N+1) polarity inversion control signals control polarities outputted by the 2(N+1) source channels respectively to generate $2^{(N+1)}$ polarity combinations.

In an embodiment, a polarity output of one of the M display lines is one of the $2^{(N+1)}$ polarity combinations.

In an embodiment, a polarity inversion control signal sequence of one of the M display lines is the first polarity inversion control signal, the second polarity inversion control signal, . . . , the N-th polarity inversion control signal and the (N+1)-th polarity inversion control signal.

In an embodiment, when N=1, the display apparatus comprises the first source channel, the second source channel, the third source channel and the fourth source channel, and the output polarity control module provides the first polarity inversion control signal and the second polarity inversion control signal; polarities outputted by the first source channel and the second source channel are controlled by the first polarity inversion control signal and polarities outputted by the third source channel and the fourth source channel are controlled by the second polarity inversion control signal.

Compared to the prior art, the driver applied to the display apparatus of the invention can effectively improve the common voltage (VCOM) jitters occurred on the conventional display panel, so that the common voltage of the display panel of the invention can approach the stable state. Therefore, the frames displayed by the display panel will also become normal due to the stable common voltage of the display panel and the colors displayed by the display panel will also become normal without deviations.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3A illustrates a schematic diagram of the polarity arrangements corresponding to the M display lines respectively in the driver of the display apparatus in an embodiment of the invention.

FIG. 3B illustrates a schematic diagram of the polarity arrangements corresponding to the 2(N+1) source channels respectively in the driver of the display apparatus of FIG. 3A.

DETAILED DESCRIPTION

Figure 1:
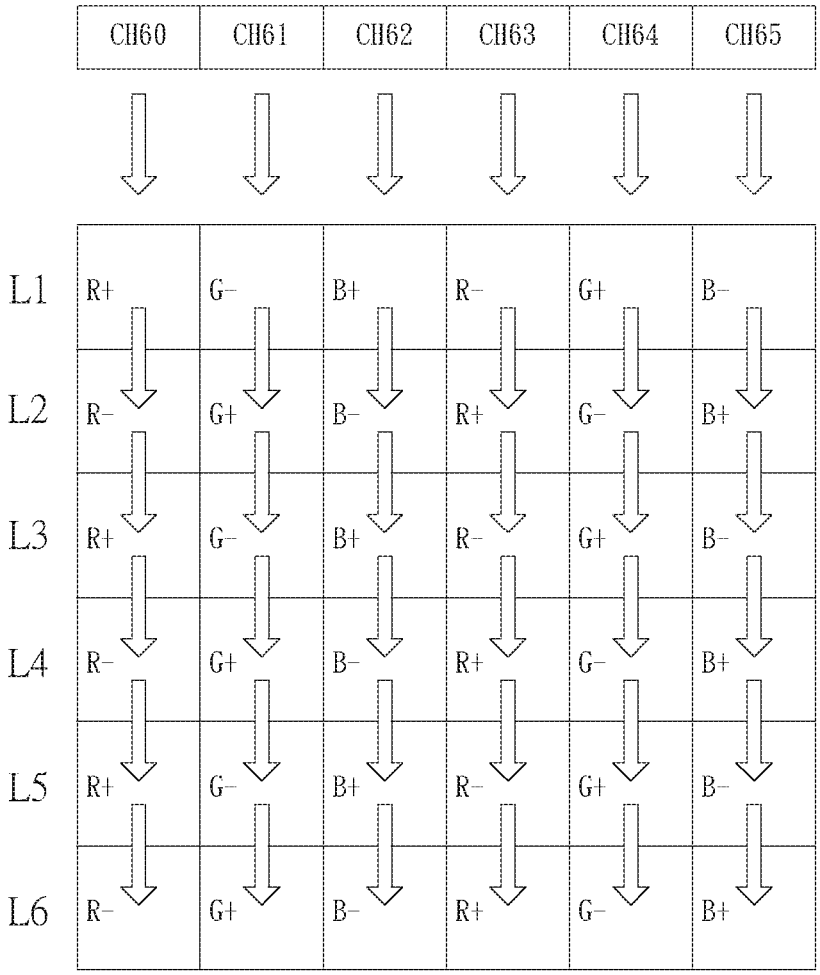
FIG. 1 (PRIOR ART)
FIG. 1 illustrates a schematic diagram of the light and dark staggered frame of the pixel matrix under dot inversion.
Figure 2A:
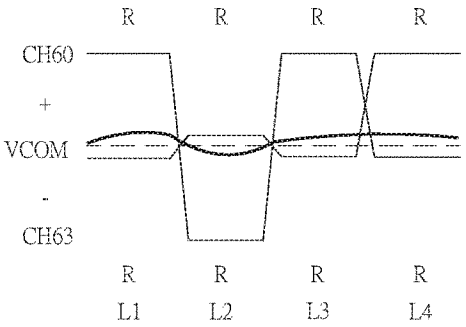
FIG. 2A (PRIOR ART)
FIG. 2A~FIG. 2C illustrate schematic diagrams of the outputted data signals and polarities of the output channels CH60 and CH63, the output channels CH61 and CH64 and the output channels CH62 and CH65 respectively.
Figure 2B:
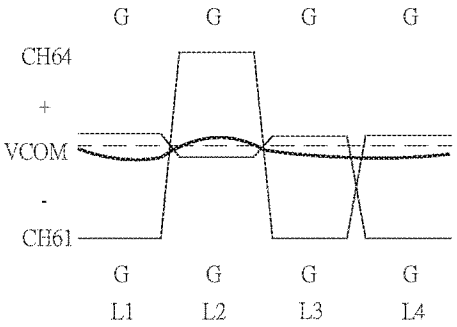
FIG. 2B (PRIOR ART)
Figure 2C:
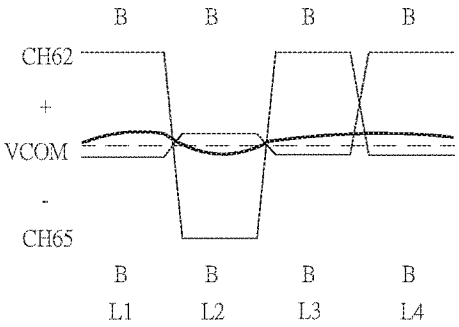
FIG. 2C (PRIOR ART)

A preferred embodiment of the invention is a driver applied to a display apparatus. In this embodiment, the display apparatus is a liquid crystal display and the driver is a source driver, but not limited to this.

It is assumed that the driver includes 2(N+1) source channels, M display lines and an output polarity control module, wherein N and M are positive integers.

The 2(N+1) source channels include a first source channel CH1, a second source channel CH2, . . . , a (2N+1)-th source channel CH(2N+1) and a 2(N+1)-th source channel CH[2(N+1)].

The M display lines include a first display line L1, a second display line L2, . . . , a (M−1)-th display line L(M−1) and a M-th display line LM. It should be noted that polarity outputs of the M display lines L1~LM are independently controlled and the polarity outputs of the M display lines L1~LM have no dependencies between each other.

The output polarity control module is configured to provide (N+1) polarity inversion control signals including a first polarity inversion control signal POL(1), a second polarity inversion control signal POL(2), . . . , a N-th polarity inversion control signal POL(N) and a (N+1)-th polarity inversion control signal POL(N+1), wherein a K-th polarity inversion control signal of the (N+1) polarity inversion control signals controls polarities outputted by a (2K−1)-th source channel and a 2K-th source channel of the 2(N+1) source channels, and K is a positive integer and $1 \leq K \leq (N+1)$. For example, the first polarity inversion control signal POL(1) is used to control polarities outputted by the first source channel CH1 and the second source channel CH2; the second polarity inversion control signal POL(2) is used to control polarities outputted by the third source channel CH3 and the fourth source channel CH4; . . . ; the N-th polarity inversion control signal is used to control polarities outputted by the (2N−1)-th source channel and the 2N-th source channel, and so on.

It should be noticed that the falling edge of the timing signal STB can be used to perform sampling process on the (N+1) polarity inversion control signals, but not limited to this.

In addition, the corresponding relationship between the values of the polarity inversion control signals and the polarities outputted by the source channels controlled by the polarity inversion control signals should be defined. It is assumed that the values of the K-th polarity inversion control signal POL(K) at the higher first level and lower second level are 0 and 1 respectively. When the value of the K-th polarity inversion control signal POL(K)=1, the polarities of the (2K−1) source channel CH(2K−1) and the 2K source channel CH(2K) controlled by the K-th polarity inversion control signal POL(K) are negative (−) and positive (+) respectively; when the value of the K-th polarity inversion control signal POL(K)=0, the polarities of the (2K−1) source channel CH(2K−1) and the 2K source channel CH(2K) controlled by the K-th polarity inversion control signal POL(K) are positive (+) and negative (−) respectively.

Therefore, it can be found that the (N+1) polarity inversion control signals POL(1)~POL(N+1) can control polarities outputted by the 2(N+1) source channels CH1~CH[2(N+1)] respectively to generate $2^{(N+1)}$ polarity combinations.

In practical applications, the 2(N+1) source channels CH1~CH[2(N+1)] are arranged in order along the first direction and the M display lines L1~LM are arranged in order along the second direction.

In an embodiment, the first direction is perpendicular to the second direction. For example, the 2(N+1) source channels CH1~CH[2(N+1)] are arranged in order along the horizontal direction (X-direction) and the M display lines L1~LM are arranged in order along the vertical direction (Y-direction), but not limited to this.

It should be noticed that the number of the M display lines L1~LM (namely the value of M) depends on the solution of the display panel of the display apparatus along the second direction. If the solution of the display panel along the second direction is higher, the number of the display lines will be larger accordingly and vice versa.

Next, the simplest condition will be introduced as follows.

It is assumed that N=1, at this time, the display apparatus includes 2(N+1) source channels (namely four source channels) and these four source channels are the first source channel CH1, the second source channel CH2, the third source channel CH3 and the fourth source channel CH4 respectively.

At this time, the output polarity control module will provide (N+1) polarity inversion control signals (namely two polarity inversion control signals) and these two polarity inversion control signals are the first polarity inversion control signal POL(1) and the second polarity inversion control signal POL(2) respectively.

Wherein, the polarities outputted by the first source channel CH1 and the second source channel CH2 are controlled by the first polarity inversion control signal POL(1) and the polarities outputted by the third source channel CH3 and the fourth source channel CH4 are controlled by the second polarity inversion control signal POL(2). It should be noticed that the falling edge of the timing signal STB can be used to perform sampling process on the first polarity inversion control signal POL(1) and the second polarity inversion control signal POL(2), but not limited to this.

From the above-mentioned definitions, it can be found that when the first polarity inversion control signal POL(1)=1, the polarity outputted by the first source channel CH1 controlled by the first polarity inversion control signal POL(1) is negative (−) and the polarity outputted by the second source channel CH2 controlled by the first polarity inversion control signal POL(1) is positive (+); when the first polarity inversion control signal POL(1)=0, the polarity outputted by the first source channel CH1 controlled by the first polarity inversion control signal POL(1) is positive (+) and the polarity outputted by the second source channel CH2 controlled by the first polarity inversion control signal POL(1) is negative (−).

Similarly, when the second polarity inversion control signal POL(2)=1, the polarity outputted by the third source channel CH3 controlled by the second polarity inversion control signal POL(2) is negative (−) and the polarity outputted by the fourth source channel CH4 controlled by the second polarity inversion control signal POL(2) is positive (+); when the second polarity inversion control signal POL(2)=0, the polarity outputted by the third source channel CH3 controlled by the second polarity inversion control signal POL(2) is positive (+) and the polarity outputted by the fourth source channel CH4 controlled by the second polarity inversion control signal POL(2) is negative (−).

In addition, from the above-mentioned definitions, it can be found that two polarity inversion control signals POL(1)~POL(2) are used to control the polarities outputted by the four source channels CH1~CH4 respectively to generate $2^2$ polarity combinations (namely four polarity combinations), as shown in Table 1.

TABLE 1

| POL(1) | POL(2) | CH1 | CH2 | CH3 | CH4 |
|---|---|---|---|---|---|
| 1 | 1 | − | + | − | + |
| 1 | 0 | − | + | + | − |
| 0 | 1 | + | − | − | + |
| 0 | 0 | + | − | + | − |

In practical applications, the two polarity inversion control signals POL(1)~POL(2) are provided by the timer control register (TCON) and they can be cooperated with another polarity inversion control signal POL_C also provided by the timer control register (TCON). If the value of the polarity inversion control signal POL_C at higher first level and lower second level are 0 and 1 respectively, there will be $2^{(2+1)}$ polarity combinations (namely eight polarity combinations), as shown in Table 2.

TABLE 2

| POL_C | POL(1) | POL(2) | CH1 | CH2 | CH3 | CH4 |
|---|---|---|---|---|---|---|
| 1 | 1 | 1 | − | + | − | + |
| 1 | 1 | 0 | − | + | + | − |
| 1 | 0 | 1 | + | − | − | + |
| 1 | 0 | 0 | + | − | + | − |
| 0 | 1 | 1 | + | − | + | − |
| 0 | 1 | 0 | + | − | − | + |
| 0 | 0 | 1 | − | + | + | − |
| 0 | 0 | 0 | − | + | − | + |

From above, it can be found that when N=1, the panel can generate $2^{(2+1)}$ polarity combinations (namely eight polarity combinations). If M=8, there are eight display lines L1~L8 and the polarity outputs of each display line L1~L8 can be one of the eight polarity combinations respectively.

For example, the polarity outputs of the display lines L1~L8 can be that the polarity outputs of the first display line L1 are (−,+,−,+), the polarity outputs of the second display line L2 are (−,+,+,−), the polarity outputs of the third display line L3 are (+,−,−,+), the polarity outputs of the fourth display line L4 are (+,−,+,−), the polarity outputs of the fifth display line L5 are (+,−,+,−), the polarity outputs of the sixth display line L6 are (+,−,−,+), the polarity outputs of the seventh display line L7 are (−,+,+,−) and the polarity outputs of the eighth display line L8 are (−,+,−,+), but not limited to this.

Please refer to FIG. 3A and FIG. 3B. FIG. 3A illustrates a schematic diagram of the polarity arrangements corresponding to the M display lines L1~LM respectively. FIG. 3B illustrates a schematic diagram of the polarity arrangements corresponding to the 2(N+1) source channels respectively. From FIG. 3A and FIG. 3B, it can be found that the entire panel can generate $2^{(N+1)}$ polarity combinations and the polarity outputs of each display line L1~LM can be one of the $2^{(N+1)}$ polarity combinations. And, the polarity inversion control signal sequence of each display line L1~LM is that the first polarity inversion control signal POL(1), the second polarity inversion control signal POL(2), . . . , a N-th polarity inversion control signal POL(N) and a (N+1)-th polarity inversion control signal POL(N+1).

As shown in FIG. 3B, the (N+1) polarity inversion control signals POL(1)~POL(N+1) are used to control the polarities outputted by the 2(N+1) source channels CH1~CH[2(N+1)] respectively to generate $2^{(N+1)}$ polarity combinations. Wherein, the first polarity inversion control signal POL(1) is used to control the first source channel CH1 and the second source channel CH2; the second polarity inversion control signal POL(2) is used to control the third source channel CH3 and the fourth source channel CH4; . . . ; the (N+1)-th polarity inversion control signal POL(N+1) is used to control the (2N+1)-th source channel CH(2N+1) and the 2(N+1)-th source channel CH[2(N+1)].

If the values of the first polarity inversion control signal POL(1), the second polarity inversion control signal POL(2), the third polarity inversion control signal POL(3), . . . , the N-th polarity inversion control signal POL(N) and the (N+1)-th polarity inversion control signal POL(N+1) are 0, 0, 1, . . . , 0, 0 respectively, then the polarity outputs of the first source channel CH1 and the second source channel CH2 controlled by the first polarity inversion control signal POL(1) are negative (−) and positive (+) respectively; the polarity outputs of the third source channel CH3 and the fourth source channel CH4 controlled by the second polarity inversion control signal POL(2) are negative (−) and positive (+) respectively; the polarity outputs of the fifth source channel CH5 and the sixth source channel CH6 controlled by the third polarity inversion control signal POL(3) are positive (+) and negative (−) respectively; . . . ; the polarity outputs of the (2N+1)-th source channel CH(2N+1) and the 2(N+1)-th source channel CH[2(N+1)] controlled by the (N+1)-th polarity inversion control signal POL(N+1) are negative (−) and positive (+) respectively.

Therefore, a shown in FIG. 3A, the polarity outputs corresponding to the 2(N+1) source channels on each display line L1~LM are that the polarity outputs corresponding to the 2(N+1) source channels on the first display line L1 are (−, +, −, +, +, −, +, −, . . . , −, +, −, +), the polarity outputs corresponding to the 2(N+1) source channels on the second display line L2 are (+, −, +, −, −, +, −, +, . . . , +, −, +, −), the polarity outputs corresponding to the 2(N+1) source channels on the third display line L3 are (+, −, +, −, −, +, −, +, . . . , +, −, +, −), the polarity outputs corresponding to the 2(N+1) source channels on the fourth display line L4 are (−, +, −, +, +, −, +, −, . . . , −, +, −, +), . . . , the polarity outputs corresponding to the 2(N+1) source channels on the M-th display line LM are (−, +, −, +, +, −, +, −, . . . , −, +, −, +) respectively, but not limited to this.

Figure 4:
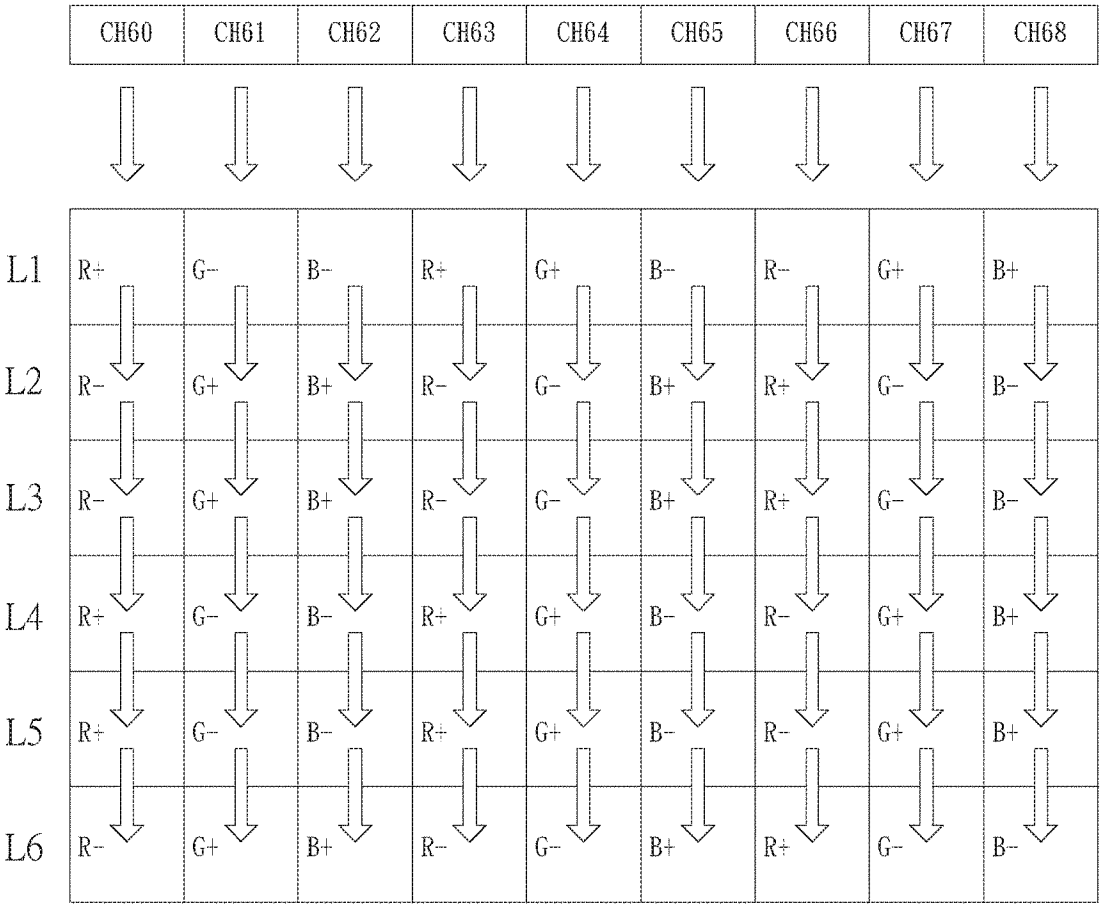
FIG. 4 illustrates a schematic diagram of the light and dark staggered frame of the pixel matrix under (2V+1) dual line dot inversion.

Please refer to FIG. 4. FIG. 4 illustrates a schematic diagram of the light and dark staggered frame of the pixel matrix under (2V+1) dual line dot inversion. As shown in FIG. 4, it is assumed that L1~L6 are display lines and CH60~CH68 are source channels, wherein the source channels CH60, CH63 and CH66 correspond to the red color (R); the source channels CH61, CH64 and CH67 correspond to the green color (G); the source channels CH62, CH65 and CH68 correspond to the blue color (B). The polarity output sequence of the display lines L1, L4 and L5 is (+, −, −, +, +, −, −, +, +); the polarity output sequence of the display lines L2, L3 and L6 is (−, +, +, −, −, +, +, −, −).

Figure 5A:
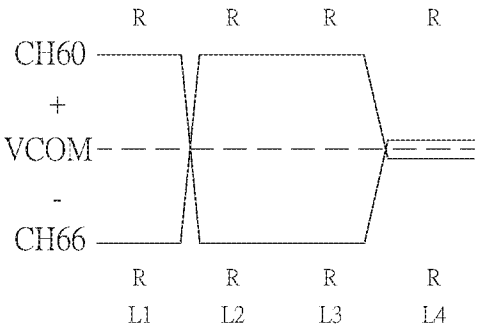
FIG. 5A~FIG. 5C illustrate schematic diagrams of the outputted data signals and polarities of the output channels CH60 and CH66, the output channels CH61 and CH67 and the output channels CH62 and CH68 respectively.
Figure 5B:
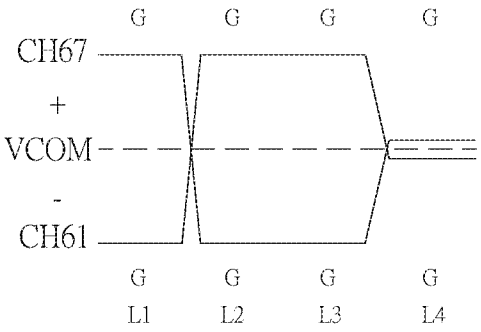
Figure 5C:
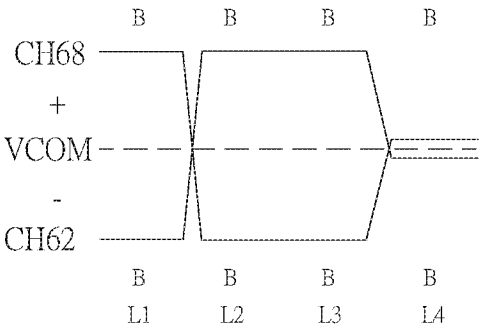

Then, Please refer to FIG. 5A~FIG. 5C. FIG. 5A~FIG. 5C illustrate schematic diagrams of the outputted data signals and polarities of the output channels CH60~CH68 respectively. As shown in FIG. 5A, the outputted data signals of the source channels CH60 and CH66 corresponding to the same red color (R) have opposite polarities and the same value; therefore, the common voltage (VCOM) of the display panel can be maintained stable as shown by the dotted lines and the common voltage (VCOM) jitters occur on the conventional display panel due to the effects of unequal voltages can be effectively avoided.

Similarly, as shown in FIG. 5B and FIG. 5C, the outputted data signals of the source channels CH61 and CH67 corresponding to the same green color (G) have opposite polarities and the same value and the outputted data signals of the source channels CH62 and CH68 corresponding to the same blue color (B) have opposite polarities and the same value; therefore, the common voltage (VCOM) of the display panel can be maintained stable as shown by the dotted lines and the common voltage (VCOM) jitters occur on the conventional display panel due to the effects of unequal voltages can be effectively avoided.

Compared to the prior art, the driver applied to the display apparatus of the invention can effectively improve the common voltage (VCOM) jitters occurred on the conventional display panel, so that the common voltage of the display panel of the invention can approach the stable state. Therefore, the frames displayed by the display panel will also become normal due to the stable common voltage of the display panel and the colors displayed by the display panel will also become normal without deviations.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A driver applied to a display apparatus, the driver comprising:

2(N+1) source channels comprising a first source channel, a second source channel, . . . , a (2N+1)-th source channel and a 2(N+1)-th source channel, wherein N is a positive integer;

M display lines comprising a first display line, a second display line, . . . , a (M−1)-th display line and a M-th display line, wherein polarity outputs of the M display lines are independently controlled and the polarity outputs of the M display lines have no dependencies between each other, wherein M is a positive integer; and an output polarity control module configured to provide (N+1) polarity inversion control signals comprising a first polarity inversion control signal, a second polarity inversion control signal, . . . , a N-th polarity inversion control signal and a (N+1)-th polarity inversion control signal, wherein a K-th polarity inversion control signal of the (N+1) polarity inversion control signals controls polarities outputted by a (2K−1)-th source channel and a 2K-th source channel of the 2(N+1) source channels, and K is a positive integer and $1 \leq K \leq (N+1)$.

2. The driver of claim 1, wherein the first source channel, the second source channel, . . . , the (2N+1)-th source channel and the 2(N+1)-th source channel are arranged in order along a first direction; the first display line, a second display line, . . . , a (M−1)-th display line and a M-th display line are arranged in order along a second direction.

3. The driver of claim 2, wherein the first direction is perpendicular to the second direction.

4. The driver of claim 2, wherein a value of M depends on a solution of a display panel of the display apparatus along the second direction.

5. The driver of claim 1, wherein when the K-th polarity inversion control signal has a first level, the K-th polarity inversion control signal controls the polarities outputted by the (2K−1)-th source channel and the 2K-th source channel to be negative (−) and positive (+) respectively; the K-th polarity inversion control signal has a first level, when the K-th polarity inversion control signal has a second level, the K-th polarity inversion control signal controls the polarities outputted by the (2K−1)-th source channel and the 2K-th source channel to be positive (+) and negative (−) respectively.

6. The driver of claim 5, wherein the first level is higher than the second level.

7. The driver of claim 1, wherein the (N+1) polarity inversion control signals control polarities outputted by the 2(N+1) source channels respectively to generate $2^{(N+1)}$ polarity combinations.

8. The driver of claim 7, wherein a polarity output of one of the M display lines is one of the $2^{(N+1)}$ polarity combinations.

9. The driver of claim 1, wherein a polarity inversion control signal sequence of one of the M display lines is the first polarity inversion control signal, the second polarity inversion control signal, . . . , the N-th polarity inversion control signal and the (N+1)-th polarity inversion control signal.

10. The driver of claim 1, wherein when N=1, the display apparatus comprises the first source channel, the second source channel, the third source channel and the fourth source channel, and the output polarity control module provides the first polarity inversion control signal and the second polarity inversion control signal; polarities outputted by the first source channel and the second source channel are controlled by the first polarity inversion control signal and polarities outputted by the third source channel and the fourth source channel are controlled by the second polarity inversion control signal.

* * * * *